US007555858B2

(12) United States Patent
Binder

(10) Patent No.: US 7,555,858 B2
(45) Date of Patent: Jul. 7, 2009

(54) HOLDER FOR HANDICAP PERMIT

(76) Inventor: Robert Binder, Franklin, MI (US); James L. Gerback, legal representative, 300 Park, Suite 375, Birmingham, MI (US) 48009

( * ) Notice: Subject to any disclaimer, the term of this patent is extended or adjusted under 35 U.S.C. 154(b) by 0 days.

(21) Appl. No.: 12/189,436

(22) Filed: Aug. 11, 2008

(65) Prior Publication Data

US 2009/0038194 A1 Feb. 12, 2009

Related U.S. Application Data

(60) Provisional application No. 60/955,058, filed on Aug. 10, 2007.

(51) Int. Cl.
*G09F 21/04* (2006.01)

(52) U.S. Cl. ..... 40/593; 40/643; 40/594; 248/690; 248/205.3; 248/909

(58) Field of Classification Search ..... 40/594, 40/593, 643, 644, 661.09; 248/690, 683, 248/309.1, 205.3; 24/306, 442, 304
See application file for complete search history.

(56) References Cited

U.S. PATENT DOCUMENTS 4,919,483 A * 4/1990 Horkey ..... 297/395
5,285,321 A * 2/1994 Nolan-Brown ..... 359/857
5,607,067 A * 3/1997 Morrissey ..... 211/50
7,093,305 B2 * 8/2006 Reilly et al. ..... 2/209.13
2004/0245302 A1 * 12/2004 McNicholas ..... 224/482

* cited by examiner

*Primary Examiner*—Cassandra Davis
(74) *Attorney, Agent, or Firm*—Gifford, Krass, Sprinkle, Anderson & Citkowski, P.C.

(57) ABSTRACT

A kit for use in securing a vehicular handicap permit to the interior of a vehicle windshield so that the permit is visible through the windshield includes a strip having Velcro on one side and a pressure-sensitive adhesive on the opposite side. The kit also includes a permit holder with pressure-sensitive adhesive on one side and a Velcro strip on the opposite side. The holder is secured to the permit by folding the holder so that two sections of the adhesive coating face one another and pressing the two sections against two sides of the permit adjacent to edges of the permit. The Velcro on the exposed side of the holder may then be secured to the Velcro on the strip, which is attached to the windshield by its pressure-sensitive coating so that the permit hangs downwardly behind the windshield.

2 Claims, 3 Drawing Sheets

HOLDER FOR HANDICAP PERMIT

CROSS REFERENCE TO RELATED APPLICATIONS

This application claims priority of U.S. Provisional Patent Application Ser. No. 60/955,058 filed Aug. 10, 2007, which is incorporated herein by reference.

FIELD OF THE INVENTION

This invention relates to apparatus which may be used to easily attach, to the windshield of a vehicle, in a readily detachable manner, a handicap driver permit of the type which must be displayed while parking in a handicapped restricted area.

BACKGROUND OF THE INVENTION

Most states issue permits to drivers who are handicapped so that they cannot walk long distances, which allow those drivers to park their vehicles in specially designated, convenient, parking locations. Typically, the permit must be displayed in such a manner that it is readily visible through the windshield of the vehicle, while the vehicle is parked in a handicapped area. The permit must be removed while the vehicle is being driven to provide for unobscured visibility through the windshield.

Most conventional handicap permits include a hook formed integrally with the permit, at its top, that must be connected to the post which attaches the rearview mirror to the windshield, in order to properly display the permit. These hooks tend to become torn or distorted through frequent use and handicapped drivers experience difficulty in reaching behind the mirror to attach or remove the permits.

SUMMARY OF THE INVENTION

This invention relates to apparatus which may be simply joined to a handicap permit and to the vehicle windshield, to allow the permit to be easily attached to and removed from the windshield area in the manner required for proper usage.

Broadly, the invention consists of two parts: first, a hook-and-eye separable fastener strip (such as Velcro) of a first polarity (either hook or loop) having a pressure-sensitive adhesive strip on the reverse side protected with a removable cover strip; and second, a permit holder consisting of a sheet of cardboard or a thin plastic which may be folded about an imprinted line so that the two sections on either side of the fold lie over one another. One side of this permit holder, on both sides of the hinge, is coated with a pressure-sensitive adhesive protected with a removable protective paper strip or strips. The opposite, or exposed, side of the permit holder on one side of the fold line, is formed with one or more Velcro strips of an opposite polarity of the first Velcro strip, also protected by a removable cover strip(s). If the first Velcro strip constitutes loops, the strip or strips on the exposed surface of the permit holder are hooks and vice versa.

In use, the protective coating over the pressure-sensitive adhesive on the first strip of Velcro material is removed and the strip is pressed against the interior side of the windshield, just behind the rearview mirror, so that the Velcro-covered side is exposed.

Next, the permit holder is secured to the two sides adjacent to the top of the handicap permit. To do this, the protective strip or strips covering the pressure-sensitive adhesive on the interior folded side of the permit holder are removed and the permit holder is then folded so that its hinge line lies along the top edge of the permit itself and its two sides lie along the opposite sides of the permit. The adhesive coated sections are then brought into contact with the two sides of the handicap permit adjacent its top so that the holder sandwiches the two sides of the permit.

The permit holder system is now ready for use. To attach the permit to the windshield area, the cover on the Velcro strip on one side of the permit is removed and the uncovered Velcro strip is simply brought into contact with the Velcro strip of the opposite polarity secured to the inner side of the windshield behind the rearview mirror. The permit then hangs downwardly below the mirror and is visible from the exterior of the automobile. The permit may be easily removed when the vehicle is to be driven by detaching the Velcro strips from one another.

A number of variations of the invention will be apparent to those of skill in the art. First, it would be possible to construct a system in accordance with the present invention in which only a single Velcro strip is attached to one side of the permit rather than using the sandwiching type system, which is more convenient but slightly more expensive. The kit would thus consist of two Velcro strips of opposite polarity each having a pressure-sensitive adhesive on the rear side, which are initially protected by protective strips. One strip is removed and that Velcro section is attached to the interior of the windshield behind the rearview mirror and the protective strip on the other Velcro section is removed and that section is attached to one side of the handicap permit, adjacent the top.

The handicap permit is thus easily attached into a use position and removed from the use position by simply securing and separating the Velcro strips.

BRIEF DESCRIPTION OF THE DRAWINGS

A preferred embodiment of the present invention is illustrated in the accompanying drawings in which.

DETAILED DESCRIPTION OF THE PREFERRED EMBODIMENTS

Figure 1:
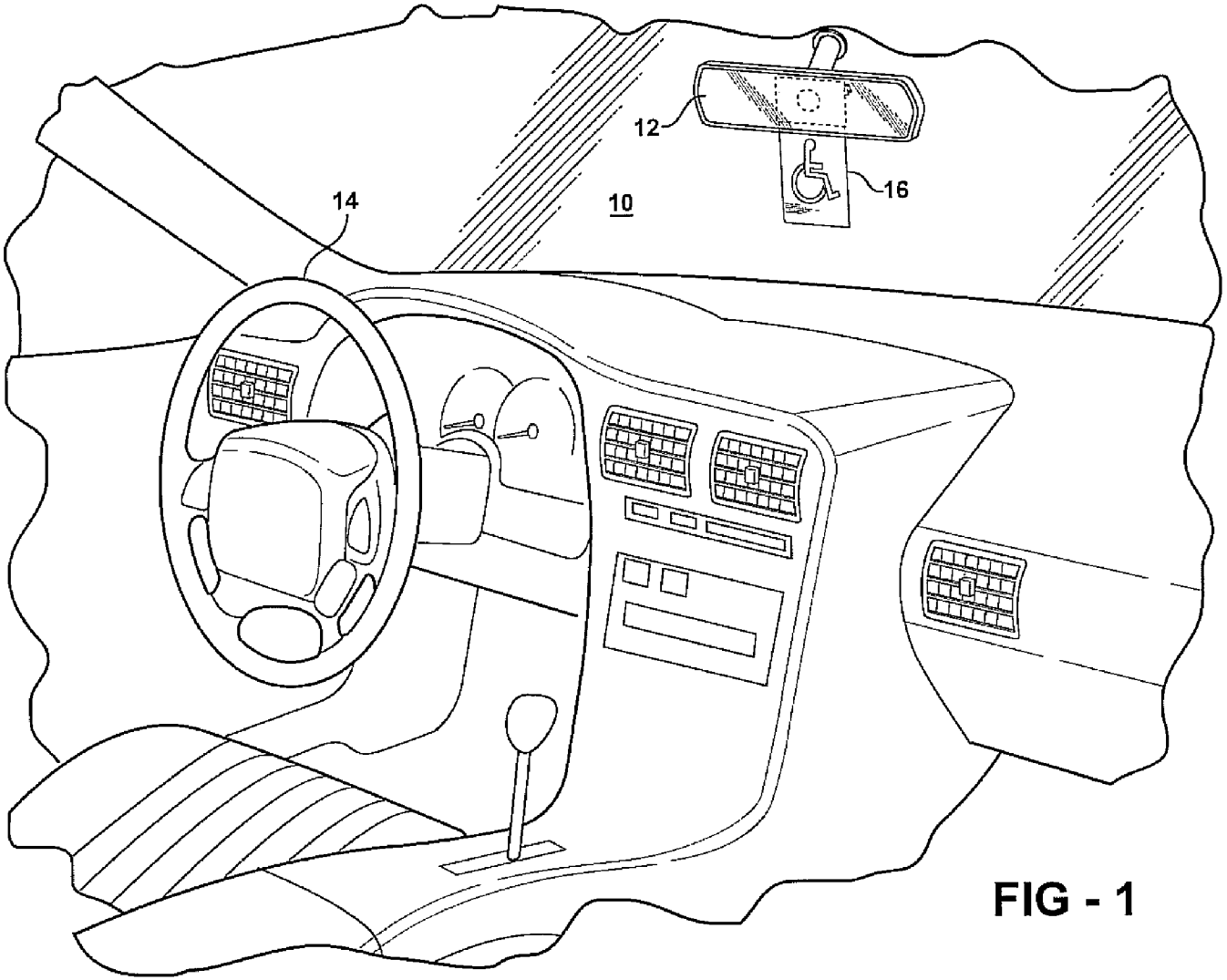
FIG. 1 is a view through the front windshield from the interior of the automobile illustrating a handicap permit attached to the interior of the windshield and hanging below the rearview mirror.

Referring to FIG. 1, which is a view through the windshield 10 of an automobile, from the interior, a rearview mirror 12 is generally disposed centrally, near the top of the windshield. The steering wheel of the automobile is indicated at 14. A handicap permit 16 is adapted to be secured, by the system of the present invention, to the interior of the windshield, behind the mirror 12, so it hangs down below the mirror.

Figure 2:
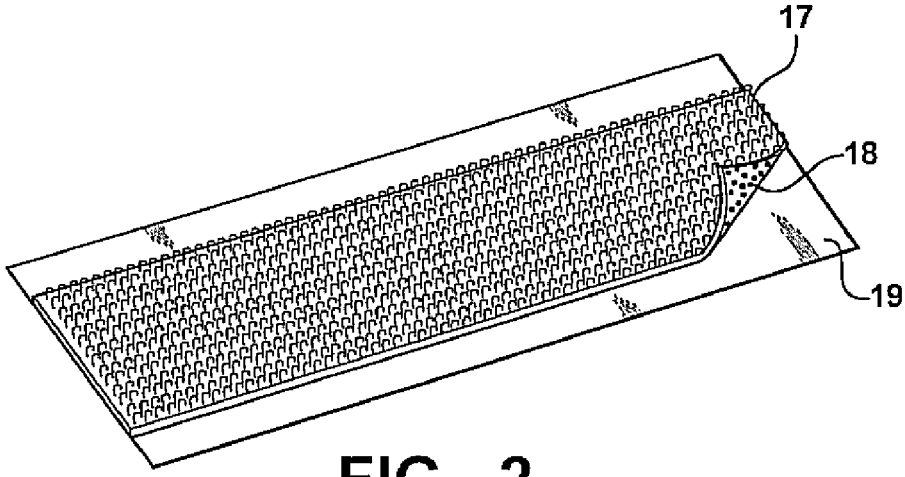
FIG. 2 is a perspective view of a first component of the present invention, comprising a strip with Velcro on one side and a pressure-sensitive adhesive on the opposite side, which is adapted to be secured to the interior of the windshield behind the mirror.

FIG. 2 illustrates one of the two components of the invention. It simply consists of an elongated flat strip of Velcro (which term is used herein to refer generically to all hook-and-loop separable fasteners) 17 of a first polarity, shown as a loop variety, having its rear side 18 coated with a pressure-sensitive adhesive and protected, prior to application within the vehicle, by a protective paper or plastic strip 19 which prevents the pressure-sensitive adhesive from sticking to other components. In use, the protective strip is removed and the adhesive coated side is pressed against the interior of the windshield, behind the mirror, in a generally horizontal position.

Figure 3:
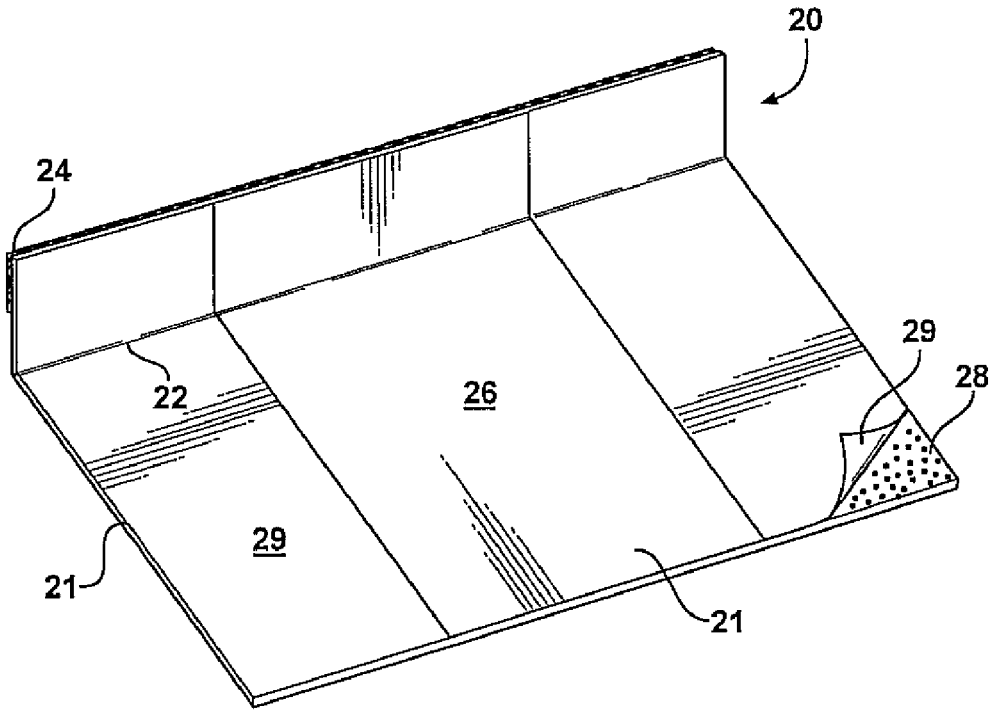
FIG. 3 is a perspective view of a second component of the present invention comprising a holder adapted to be secured to the top of a handicap permit.
Figure 4:
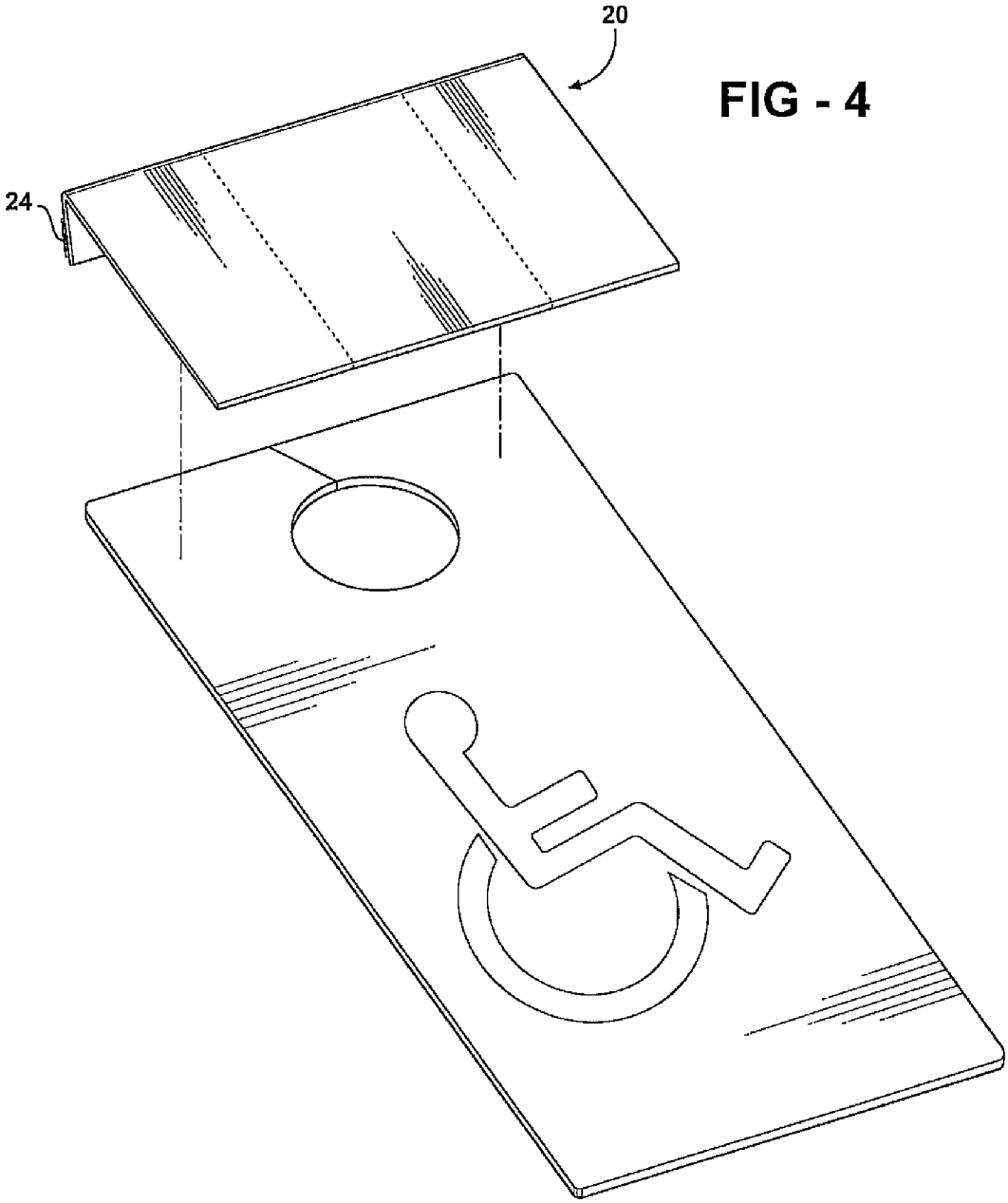
FIG. 4 is a perspective view of a permit and permit holder in a separated position.

The second component of the invention, a holder for the handicap permit, generally indicated at 20 in FIGS. 3 and 4, consists of a sheet 21 of thin plastic or cardboard which is divided into two sections about a fold line 22. A Velcro section 24 of opposite polarity from the strip 17 is attached to the sheet on one side of the fold line 22. Section 26, on the opposite side of the fold line 22, may include printed instructions for application of the device (not shown). One or more pressure-sensitive adhesive sections, such as 28, are formed on the opposite side of the holder 20 and are covered by protective strips 29. The strip(s) 28 cross the fold line 22 so as to extend on both sides of the fold.

In use, the protective coatings 29 on the rear side of the holder 20 are removed and the adhesive sections 28 are secured to the top of the handicap permit 16 so that the fold line 22 extends along the top edge of the permit. Opposite sides of the pressure-sensitive adhesive engages the opposed side of the permit 16.

The Velcro strip 24 on the permit holder 20 may then be secured on the strip 18 affixed to the windshield to display the permit. It may be easily attached and removed by the handicapped person.

Having thus described my invention I claim:

1. A two-piece apparatus for securing a handicap permit to the interior of a vehicle behind the rearview mirror, comprising:

a first strip of elongated flexible material having a hook and loop fastener material of a first polarity on one side and a first pressure-sensitive adhesive on the other side;

a first protective strip covering the pressure-sensitive adhesive on the other side of the first strip and allowing the first protective strip to be removed to secure the first adhesive to the interior of an automotive windshield behind the rearview mirror; and a holder adapted to be secured to the top of a handicap permit, comprising a planar section foldable about a fold line, comprising a mating strip of hook and loop fastener material of a second polarity attached to the planar section on one side of the fold line, and a second pressure-sensitive adhesive on the other side of the planar section, the second pressure-sensitive adhesive being protected by a second removable flexible protective strip(s);

whereby the holder may be secured to the handicap permit by removing the second protective strip(s) and pressing the second pressure-sensitive adhesive against opposite sides of the top of the handicap permit so that the fold line of the holder aligns with the top edge of the permit and the mating strip of hook and loop fastener material on the holder allows securement to the hook and loop fastener material of the first strip on the interior of the automotive windshield so that the permit hangs down below the rearview mirror.

2. A two-piece kit for removably securing a sheet handicap permit to a vehicle having a rearview mirror attached to its windshield so that the permit is visible through the windshield, comprising:

a first component comprising a first strip of hook and loop fastener material of a first polarity having a first pressure-sensitive coating on its rear side and a flexible first protective strip removably secured to the first pressure-sensitive coating so that when the first protective strip is removed the first pressure-sensitive coating may be used to secure the first strip of hook and loop fastener material of the windshield; and a second component comprising a card folded into two sections about a fold line and having a second pressure-sensitive coating on one side, extending across the fold line and a mating strip of hook and loop fastener material of a second polarity on the other side, so that the card may be secured to the sheet handicap permit by pressing the second pressure-sensitive coating to two sides of a sheet permit so the fold line lies over an edge of the permit, allowing the mating strip of hook and loop fastener material of the second polarity to be secured to the strip of hook and loop fastener material of the first polarity attached to the windshield.

* * * * *

UNITED STATES PATENT AND TRADEMARK OFFICE

CERTIFICATE OF CORRECTION

PATENT NO. : 7,555,858 B2
APPLICATION NO. : 12/189436
DATED : July 7, 2009
INVENTOR(S) : Robert Binder et al.

It is certified that error appears in the above-identified patent and that said Letters Patent is hereby corrected as shown below:

On the title page

Inventor (76):

Delete "Robert Binder, Franklin, MI (US);
James L. Gerback, legal representative,
300 Park, Suite 375, Birmingham, MI
(US) 48009"

Insert -- Robert Binder, Franklin, MI (US) Deceased;
by James L. Gerback, his legal representative,
300 Park, Suite 375, Birmingham, MI
(US) 48009 --

Signed and Sealed this
Third Day of November, 2015

Michelle K. Lee

Michelle K. Lee
*Director of the United States Patent and Trademark Office*